US006200192B1

(12) United States Patent
Hou

(10) Patent No.: US 6,200,192 B1
(45) Date of Patent: Mar. 13, 2001

(54) TOY DEVICE

(76) Inventor: Chin-Jung Hou, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/533,224

(22) Filed: Mar. 21, 2000

(51) Int. Cl.[7] ..... A63H 13/00

(52) U.S. Cl. ..... 446/358; 446/352; 446/376; 446/379

(58) Field of Search ..... 446/298, 330, 446/352, 353, 354, 358, 376, 379, 380; 40/414, 415, 418, 419, 420

(56) References Cited

U.S. PATENT DOCUMENTS 5,911,617 * 6/1999 Chou ..... 446/353
5,941,756 * 8/1999 Chou ..... 446/330
6,126,509 * 10/2000 Chou ..... 446/358

* cited by examiner

*Primary Examiner*—Jacob K. Ackun
*Assistant Examiner*—Jeffrey D. Carlson

(57) ABSTRACT

A toy device has a base seat, a platform disposed on the base seat, a first drive mechanism disposed between the base seat and the platform, and a first toy figure disposed on the platform. The base seat has a hollow interior, and an inner periphery recess. The platform is inserted in the inner periphery recess of the base seat. The first toy figure has a trunk, a pair of lower limbs connected to the trunk, and a pair of upper limbs connected to the trunk. The first drive mechanism drives the lower limbs of the first toy figure to vibrate.

3 Claims, 13 Drawing Sheets

TOY DEVICE

BACKGROUND OF THE INVENTION

The present invention relates to a toy device. More particularly, the present invention relates to a toy device which has one or more movable toy figures.

A conventional toy device has a toy figure which cannot move an upper limb of the toy figure nor vibrate a lower limb of the toy figure.

SUMMARY OF THE INVENTION

An object of the present invention is to provide a toy device which has at least a movable toy figure having a pair of upper limbs to be moved and a pair of lower limbs to be vibrated.

In accordance with a first preferred embodiment of the present invention, a toy device comprises a base seat, a platform disposed on the base seat, a first drive mechanism disposed between the base seat and the platform, and a first toy figure disposed on the platform. The base seat has a hollow interior, an inner periphery recess, a cell box disposed in the base seat, a switch disposed on the cell box, and a horn disposed in the base seat. The platform is inserted in the inner periphery recess of the base seat. The platform has a pressing button and an oblong aperture. The first drive mechanism has a first male mount, a first female mount engaging with the first male mount, a first motor disposed between the first male mount and the first female mount, a first shaft disposed between the first male mount and the first female mount, a second shaft disposed between the first male mount and the first female mount, and a third shaft disposed between the first male mount and the first female mount. A first gear, a second gear, and a third gear are disposed between the first male mount and the first female mount. A first belt pulley, a first belt roller, and a fourth gear are disposed on the first female mount. An eccentric hollow pillar is disposed on the fourth gear. The first motor has a first motor shaft passing through the first female mount and the first belt pulley. The first male mount has a first hollow post receiving the first shaft, a second hollow post receiving the second shaft, and a third hollow post receiving the third shaft. The first shaft passes through the first gear, the first female mount, and the first belt roller. The second shaft passes through the second gear. The third shaft passes through the third gear, the first female mount, and the fourth gear. A first belt surrounds the first belt pulley and the first belt roller. The first gear engages with the second gear. The second gear engages with the third gear. The first motor drives the first motor shaft to rotate. The first motor shaft drives the first belt pulley to rotate. The first belt pulley drives the first belt roller to rotate. The first belt roller drives the first shaft to rotate. The first shaft drives the first gear to rotate. The first gear drives the second gear to rotate. The second gear drives the third gear to rotate. The third gear drives the third shaft to rotate. The third shaft drives the fourth gear to rotate. The first toy figure has a trunk, a pair of lower limbs connected to the trunk, a pair of upper limbs connected to the trunk, and a head disposed on the trunk. A blocking plate is disposed between the two lower limbs. The blocking plate has a plurality of through apertures. Each of the lower limbs has a foot and a leg. The foot has an oblong hole. The leg has a lower lobe, an upper lobe, and a toothed block connected to the upper lobe. The toothed block has a plurality of teeth. The lower lobe of the leg is inserted in the oblong hole of the foot. A toothed connection plate couples with the leg. A lower portion of the toothed connection plate and the lower lobe of the leg are fastened together. A lower portion of the toothed connection plate is inserted in the oblong hole of the foot and the oblong aperture of the platform to engage with the fourth gear. The trunk has a front plate, a rear plate, a pair of lateral casings disposed between the front plate and the rear plate, and an upper box disposed on the front plate and the rear plate. The front plate has an upper circular hole and a plurality of solid rods. The rear plate has an upper round hole and a plurality of hollow rods receiving the solid rods. Each of the lateral casings has a pair of lower lug plates and an upper bar. Each end of the blocking plate is inserted in a spacing formed between the respective pair of the lower lug plates. The upper lobe and the respective lower lug plate are fastened pivotally. The upper box has two openings and a hollow column. A vibrating mechanism is disposed in the upper box. The vibrating mechanism has a toothed wheel, a pair of pinions, and a pair of transmission rods inserted through the openings of the upper box. Each of the upper limbs has an arm connected to the respective transmission rod, and a hand connected to the arm.

In accordance with a second preferred embodiment of the present invention, a toy device comprises a base seat, a platform disposed on the base seat, a first drive mechanism disposed between the base seat and the platform, a second drive mechanism disposed between the base seat and the platform, a first toy figure disposed on the platform, a second toy figure disposed on the platform, and a third toy figure disposed on the platform. The base seat has a hollow interior, an inner periphery recess, a cell box disposed in the base seat, a switch disposed on the cell box, and a horn disposed in the base seat. The platform is inserted in the inner periphery recess of the base seat. The platform has a pressing button and an oblong aperture. The first drive mechanism has a first male mount, a first female mount engaging with the first male mount, a first motor disposed between the first male mount and the first female mount, a first shaft disposed between the first male mount and the first female mount, a second shaft disposed between the first male mount and the first female mount, and a third shaft disposed between the first male mount and the first female mount. A first gear, a second gear, and a third gear are disposed between the first male mount and the first female mount. A first belt pulley, a first belt roller, and a fourth gear are disposed on the first female mount. An eccentric hollow pillar is disposed on the fourth gear. The first motor has a first motor shaft passing through the first female mount and the first belt pulley. The first male mount has a first hollow post receiving the first shaft, a second hollow post receiving the second shaft, and a third hollow post receiving the third shaft. The first shaft passes through the first gear, the first female mount, and the first belt roller. The second shaft passes through the second gear. The third shaft passes through the third gear, the first female mount, and the fourth gear. A first belt surrounds the first belt pulley and the first belt roller. The first gear engages with the second gear. The second gear engages with the third gear. The first motor drives the first motor shaft to rotate. The first motor shaft drives the first belt pulley to rotate. The first belt pulley drives the first belt roller to rotate. The first belt roller drives the first shaft to rotate. The first shaft drives the first gear to rotate. The first gear drives the second gear to rotate. The second gear drives the third gear to rotate. The third gear drives the third shaft to rotate. The third shaft drives the fourth gear to rotate. The first toy figure has a trunk, a pair of lower limbs connected to the trunk, a pair of upper limbs connected to the trunk, and a head disposed on the trunk. A blocking plate is disposed between the two lower limbs. The blocking plate has a plurality of through apertures. Each of the lower limbs has a foot and a leg. The foot has an oblong hole. The leg has a lower lobe, an upper lobe, and a toothed block connected to the upper lobe. The toothed block has a plurality of teeth. The lower lobe of the leg is inserted in the oblong hole of the foot. A toothed connection plate couples with the leg. A lower portion of the toothed connection plate and the lower lobe of the leg are fastened together. A lower portion of the toothed connection plate is inserted in the oblong hole of the foot and the oblong aperture of the platform to engage with the fourth gear. The trunk has a front plate, a rear plate, a pair of lateral casings disposed between the front plate and the rear plate, and an upper box disposed on the front plate and the rear plate. The front plate has an upper circular hole and a plurality of solid rods. The rear plate has an upper round hole and a plurality of hollow rods receiving the solid rods. Each of the lateral casings has a pair of lower lug plates and an upper bar. Each end of the blocking plate is inserted in a spacing formed between the respective pair of the lower lug plates. The upper lobe and the respective lower lug plate are fastened pivotally. The upper box has two openings and a hollow column. A vibrating mechanism is disposed in the upper box. The vibrating mechanism has a toothed wheel, a pair of pinions, and a pair of transmission rods inserted through the openings of the upper box. Each of the upper limbs has an arm connected to the respective transmission rod, and a hand connected to the arm. The structure of the second toy figure is the same as the first toy figure. The structure of the third toy figure is the same as the first toy figure. The second drive mechanism has a second male mount, a second female mount engaging with the second male mount, a second motor disposed between the second male mount and the second female mount, a fourth shaft disposed between the second male mount and the second female mount, a fifth shaft disposed between the second male mount and the second female mount, and a sixth shaft disposed between the second male mount and the second female mount. A fifth gear, a sixth gear, and a seventh gear are disposed between the second male mount and the second female mount. A second belt pulley, a second belt roller, and an eighth gear are disposed on the second male mount. A second eccentric hollow pillar is disposed on the eighth gear. The second motor has a second motor shaft passing through the second male mount and the second belt pulley. The second male mount has a fourth hollow post receiving the fourth shaft, a fifth hollow post receiving the fifth shaft, and a sixth hollow post receiving the sixth shaft. The fourth shaft passes through the fifth gear, the second male mount, and the second belt roller. The fifth shaft passes through the sixth gear. The sixth shaft passes through the seventh gear, the second male mount, and the eighth gear. A second belt surrounds the second belt pulley and the second belt roller. The fifth gear engages with the sixth gear. The sixth gear engages with the seventh gear. The second motor drives the second motor shaft to rotate. The second motor shaft drives the second belt pulley to rotate. The second belt pulley drives the second belt roller to rotate. The second belt roller drives the fourth shaft to rotate. The fourth shaft drives the fifth gear to rotate. The fifth gear drives the sixth gear to rotate. The sixth gear drives the seventh gear to rotate. The seventh gear drives the sixth shaft to rotate. The sixth shaft drives the eighth gear to rotate. A link rod has a first through hole receiving the second belt roller and a second through hole. A first doll encloses the first toy figure. A second doll encloses the second toy figure. A third doll encloses the third toy figure. The second toy figure comprises a lower limb connected to a connection panel. The connection panel has a slot. The link rod and the connection panel are fastened together via the slot and the second through hole.

DETAILED DESCRIPTION OF THE INVENTION

Figure 1:
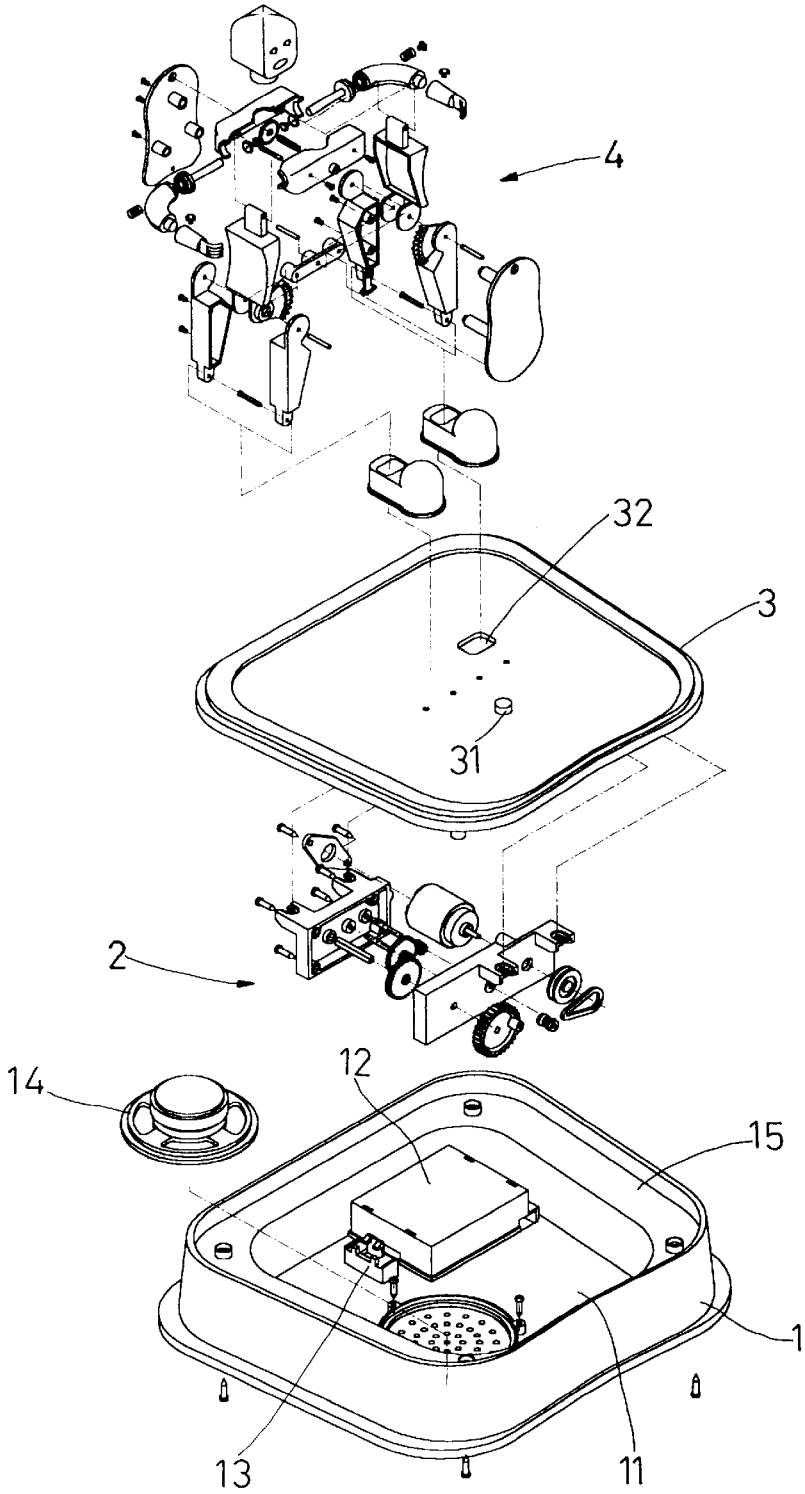
FIG. 1 is a perspective exploded view of a toy device of a first preferred embodiment in accordance with the present invention.
Figure 2:
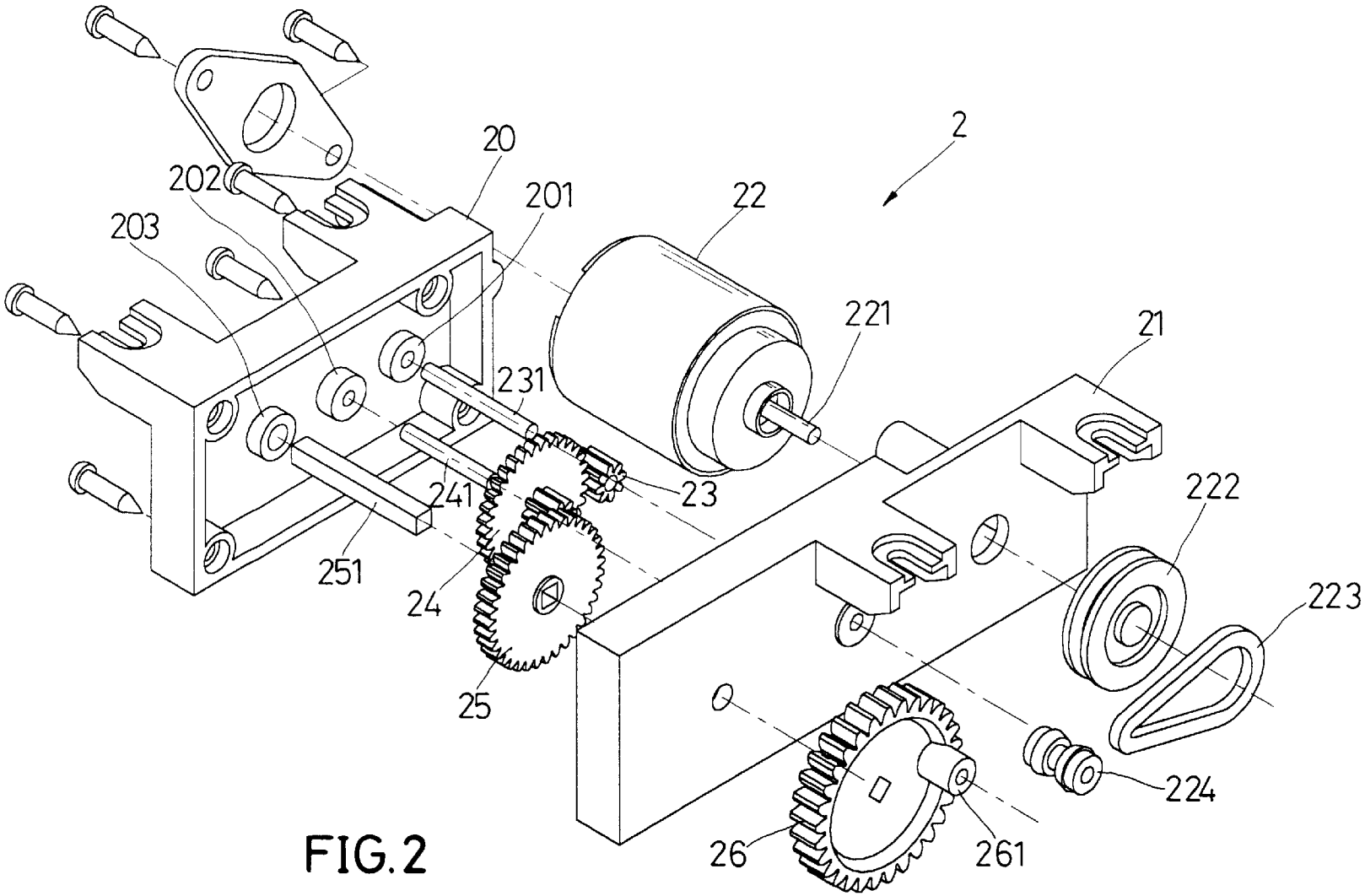
FIG. 2 is a perspective exploded view of a first drive mechanism of a first preferred embodiment in accordance with the present invention.
Figure 3:
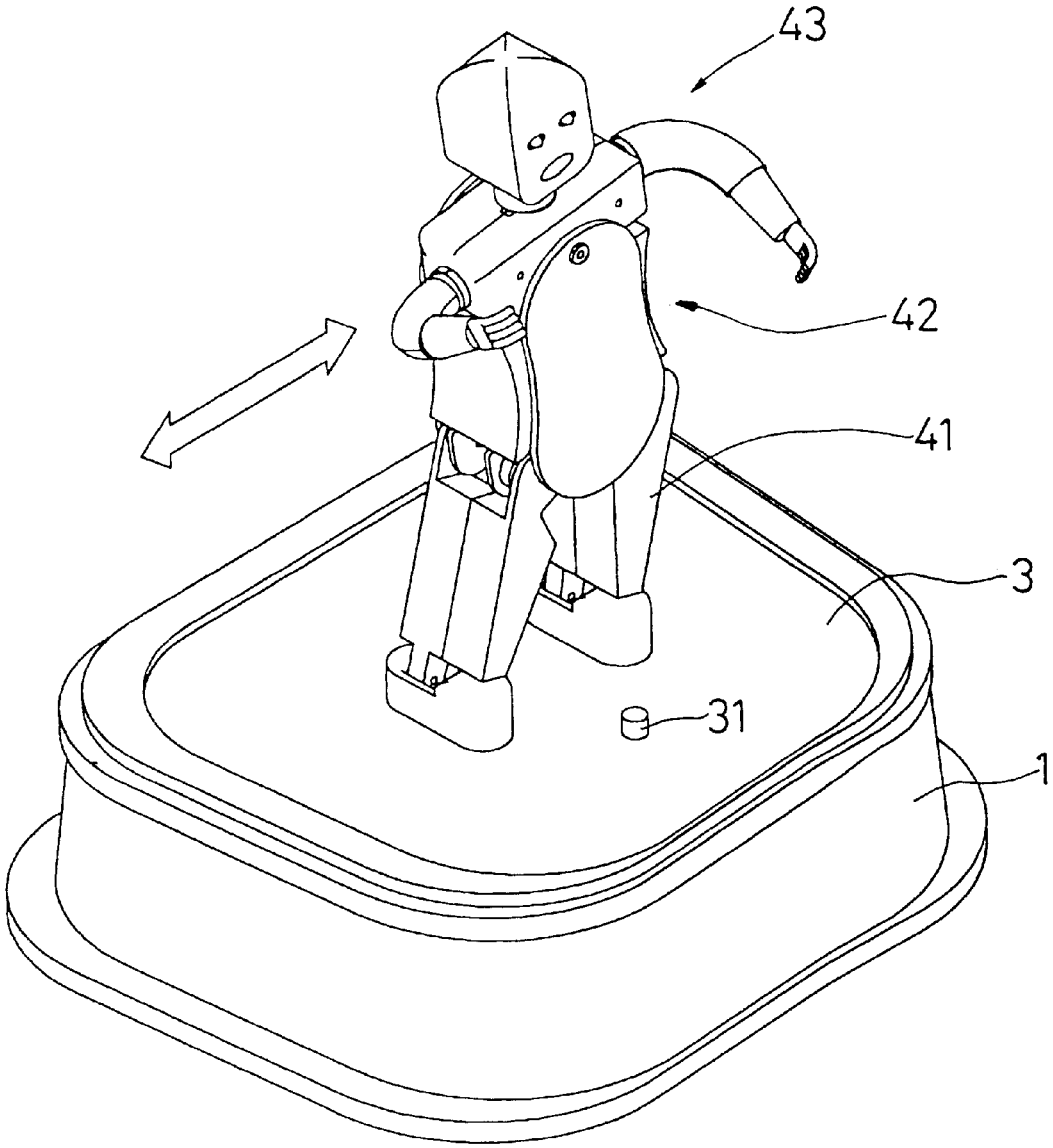
FIG. 3 is a perspective assembly view of a toy device of a first preferred embodiment in accordance with the present invention.
Figure 4:
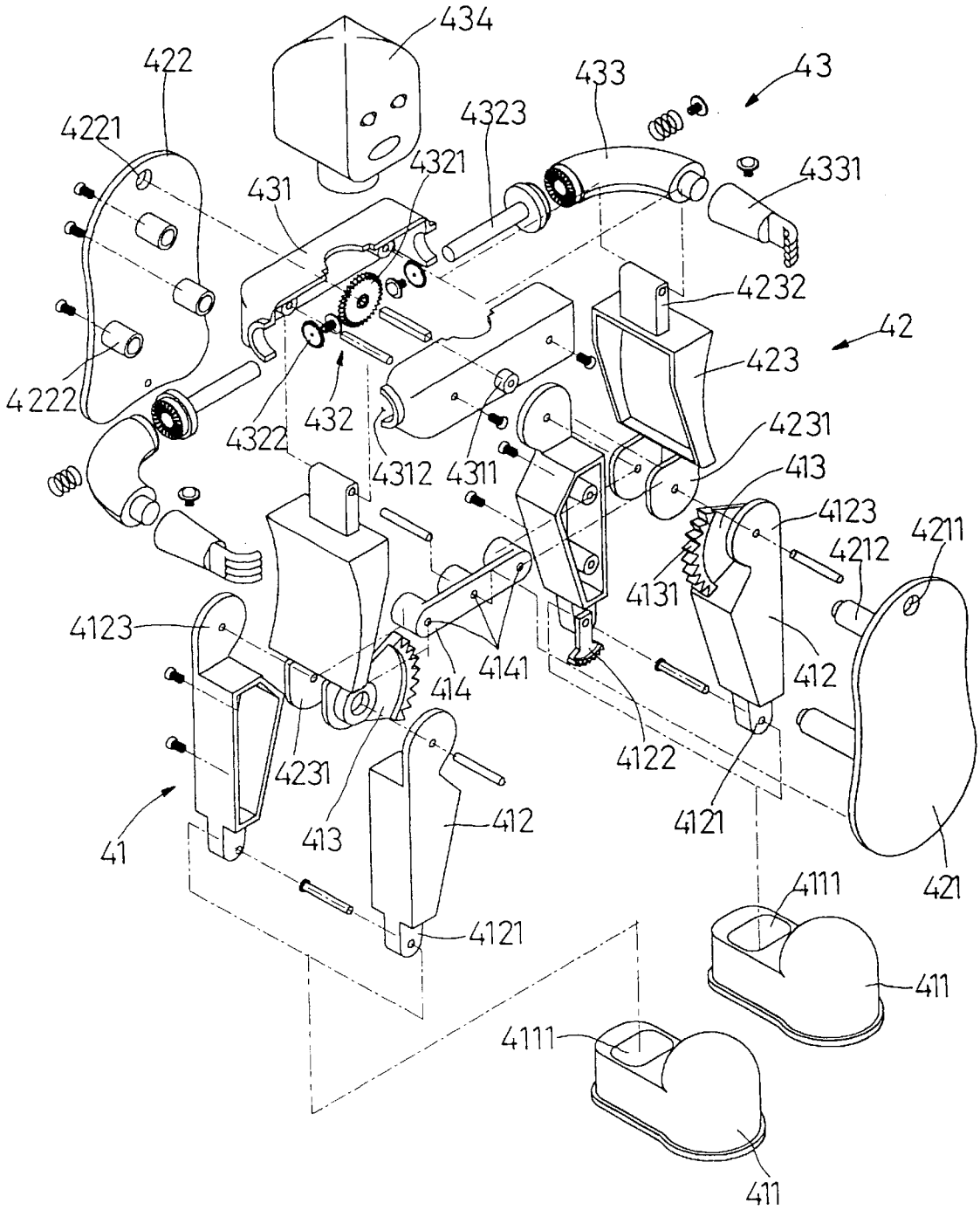
FIG. 4 is a perspective exploded view of a first toy figure of a first preferred embodiment in accordance with the present invention.
Figure 5:
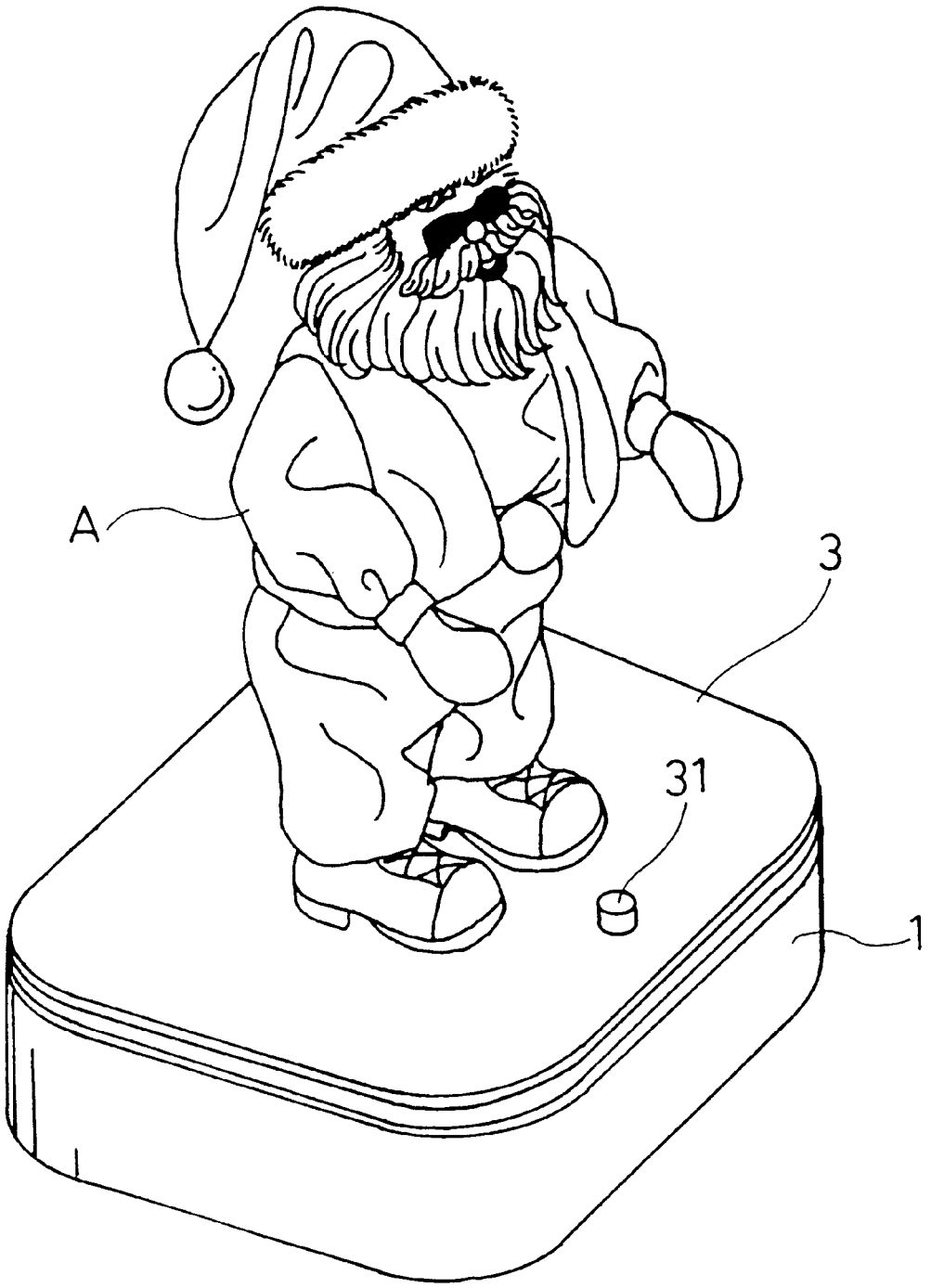
FIG. 5 is a perspective assembly view of a toy device of a first preferred embodiment with a first doll enclosing a first toy figure.

Referring to FIGS. 1 to 7, a first toy device comprises a base seat 1, a platform 3 disposed on the base seat 1, a first drive mechanism 2 disposed between the base seat 1 and the platform 3, and a first toy FIG. 4 disposed on the platform 3.

The base seat 1 has a hollow interior 11, an inner periphery recess 15, a cell box 12 disposed in the base seat 1, a switch 13 disposed on the cell box 12, and a horn 14 disposed in the base seat 1.

The platform 3 is inserted in the inner periphery recess 15 of the base seat 1. The platform 3 has a pressing button 31 and an oblong aperture 32.

The first drive mechanism 2 has a first male mount 20, a first female mount 21 engaging with the first male mount 20, a first motor 22 disposed between the first male mount 20 and the first female mount 21, a first shaft 231 disposed between the first male mount 20 and the first female mount 21, a second shaft 241 disposed between the first male mount 20 and the first female mount 21, and a third shaft 251 disposed between the first male mount 20 and the first female mount 21.

A first gear 23, a second gear 24, and a third gear 25 are disposed between the first male mount 20 and the first female mount 21.

A first belt pulley 222, a first belt roller 224, and a fourth gear 26 are disposed on the first female mount 21. An eccentric hollow pillar 261 is disposed on the fourth gear 26.

The first motor 22 has a first motor shaft 221 passing through the first female mount 21 and the first belt pulley 222.

The first male mount 20 has a first hollow post 201 receiving the first shaft 231, a second hollow post 202 receiving the second shaft 241, and a third hollow post 203 receiving the third shaft 251.

The first shaft 231 passes through the first gear 23, the first female mount 21, and the first belt roller 224.

The second shaft 241 passes through the second gear 24.

The third shaft 251 passes through the third gear 25, the first female mount 21, and the fourth gear 26.

A first belt 223 surrounds the first belt pulley 222 and the first belt roller 224.

The first gear 23 engages with the second gear 24. The second gear 24 engages with the third gear 25.

The first motor 22 drives the first motor shaft 221 to rotate. The first motor shaft 221 drives the first belt pulley 222 to rotate. The first belt pulley 222 drives the first belt roller 224 to rotate. The first belt roller 224 drives the first shaft 231 to rotate. The first shaft 231 drives the first gear 23 to rotate. The first gear 23 drives the second gear 24 to rotate. The second gear 24 drives the third gear 25 to rotate. The third gear 25 drives the third shaft 251 to rotate. The third shaft 251 drives the fourth gear 26 to rotate.

The first toy FIG. 4 has a trunk 42, a pair of lower limbs 41 connected to the trunk 42, a pair of upper limbs 43 connected to the trunk 42, and a head 434 disposed on the trunk 42.

A blocking plate 414 is disposed between the two lower limbs 41. The blocking plate 414 has a plurality of through apertures 4141.

Each of the lower limbs 41 has a foot 411 and a leg 412. The foot 411 has an oblong hole 4111. The leg 412 has a lower lobe 4121, an upper lobe 4123, and a toothed block 413 connected to the upper lobe 4123. The toothed block 413 has a plurality of teeth 4131. The lower lobe 4121 of the leg 412 is inserted in the oblong hole 4111 of the foot 411.

A toothed connection plate 4122 couples with the leg 412. A lower portion of the toothed connection plate 4122 and the lower lobe 4121 of the leg 412 are fastened together. A lower portion of the toothed connection plate 4122 is inserted in the oblong hole 4111 of the foot 411 and the oblong aperture 32 of the platform 3 to engage with the fourth gear 26.

The trunk 42 has a front plate 421, a rear plate 422, a pair of lateral casings 423 disposed between the front plate 421 and the rear plate 422, and an upper box 431 disposed on the front plate 421 and the rear plate 422. The front plate 421 has an upper circular hole 4211 and a plurality of solid rods 4212.

The rear plate 422 has an upper round hole 4221 and a plurality of hollow rods 4222 receiving the solid rods 4212.

Each of the lateral casings 423 has a pair of lower lug plates 4231 and an upper bar 4232.

Each end of the blocking plate 414 is inserted in a spacing formed between the respective pair of the lower lug plates 4231.

The upper lobe 4123 and the respective lower lug plate 4231 are fastened pivotally.

The upper box 431 has two openings 4312 and a hollow column 4311.

A vibrating mechanism 432 is disposed in the upper box 431. The vibrating mechanism 432 has a toothed wheel 4321, a pair of pinions 4322, and a pair of transmission rods 4323 inserted through the openings 4312 of the upper box 431.

Each of the upper limbs 43 has an arm 433 connected to the respective transmission rod 4323, and a hand 4331 connected to the arm 433.

A first doll A encloses the first toy FIG. 4.

Figure 6:
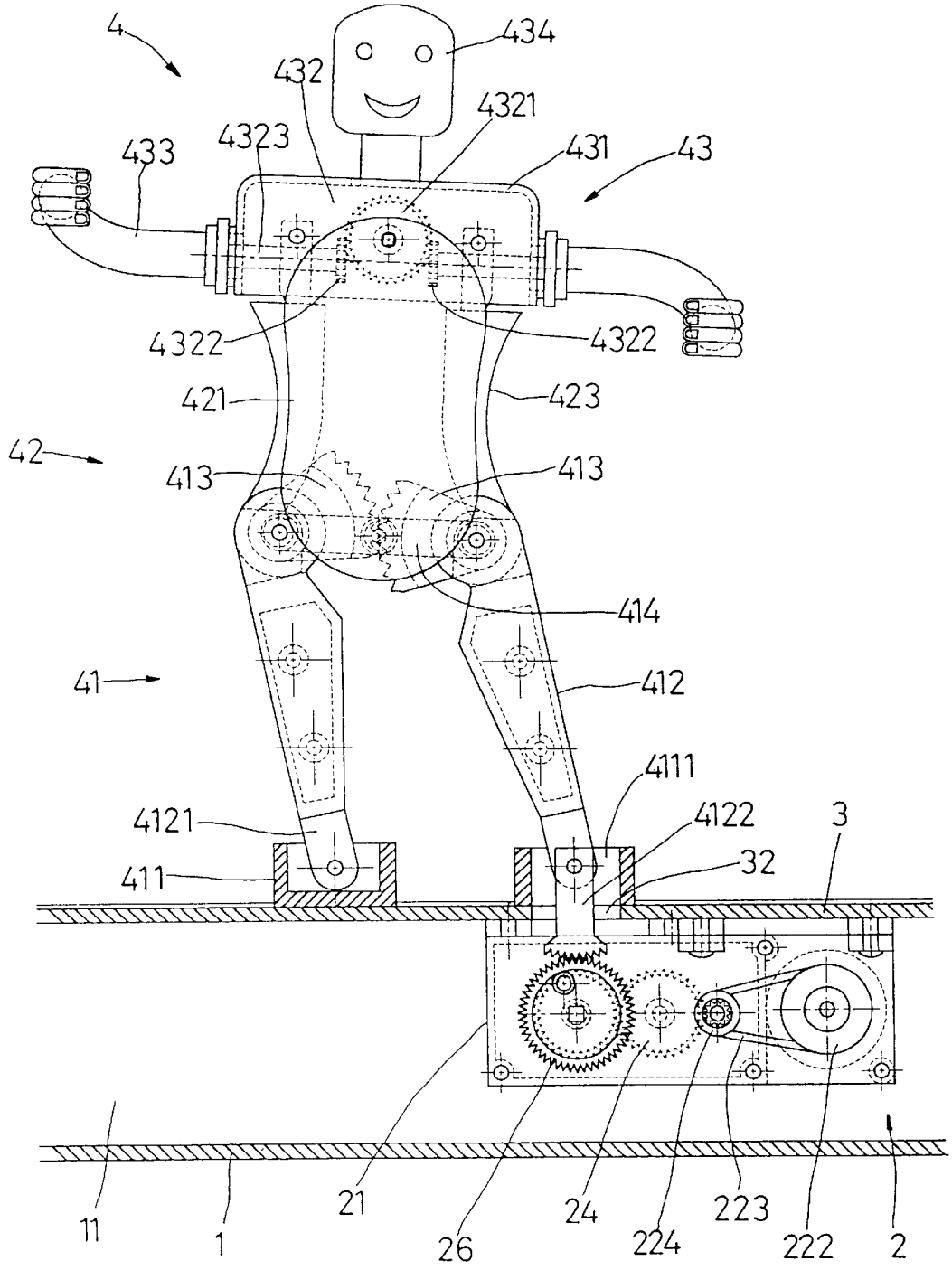
FIG. 6 is a schematic view illustrating an operation of a first toy figure of a first preferred embodiment in accordance with the present invention.
Figure 7:
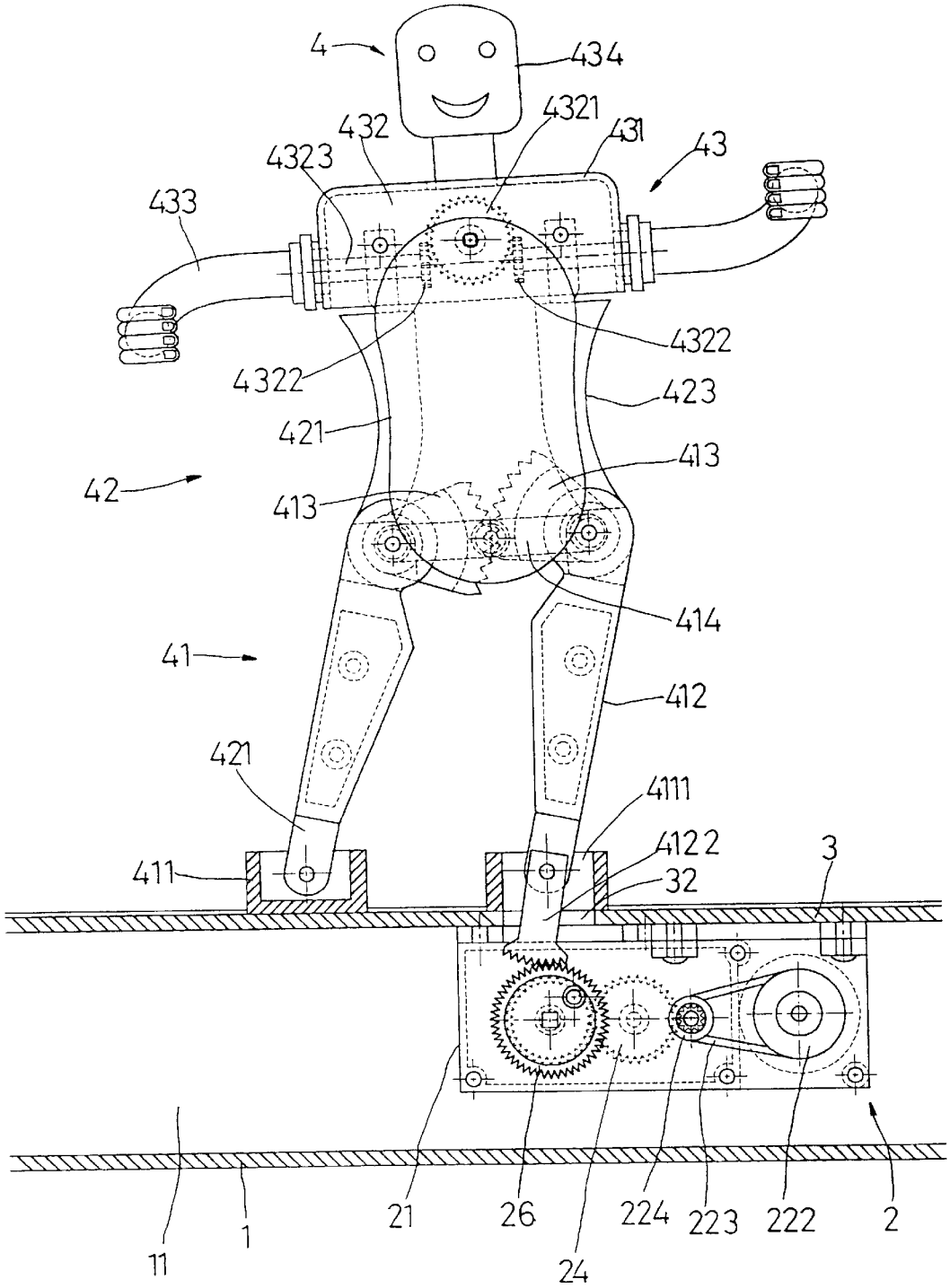
FIG. 7 is a schematic view illustrating another operation of a first toy figure of a first preferred embodiment in accordance with the present invention.
Figure 8:
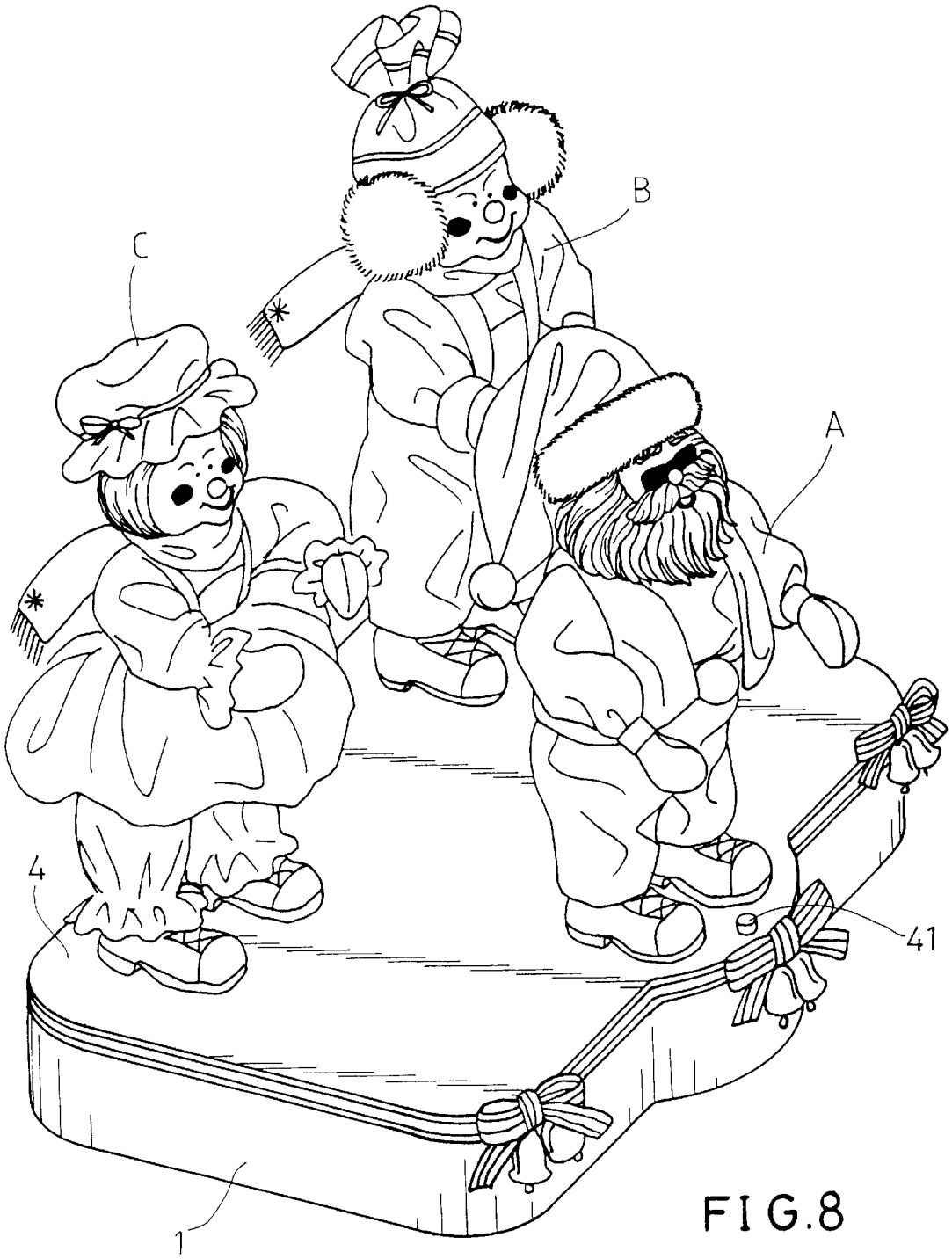
FIG. 8 is a perspective assembly view of a toy device of a second preferred embodiment with a first doll enclosing a first toy figure, a second doll enclosing a second toy figure, and a third doll enclosing a third toy figure.
Figure 9:
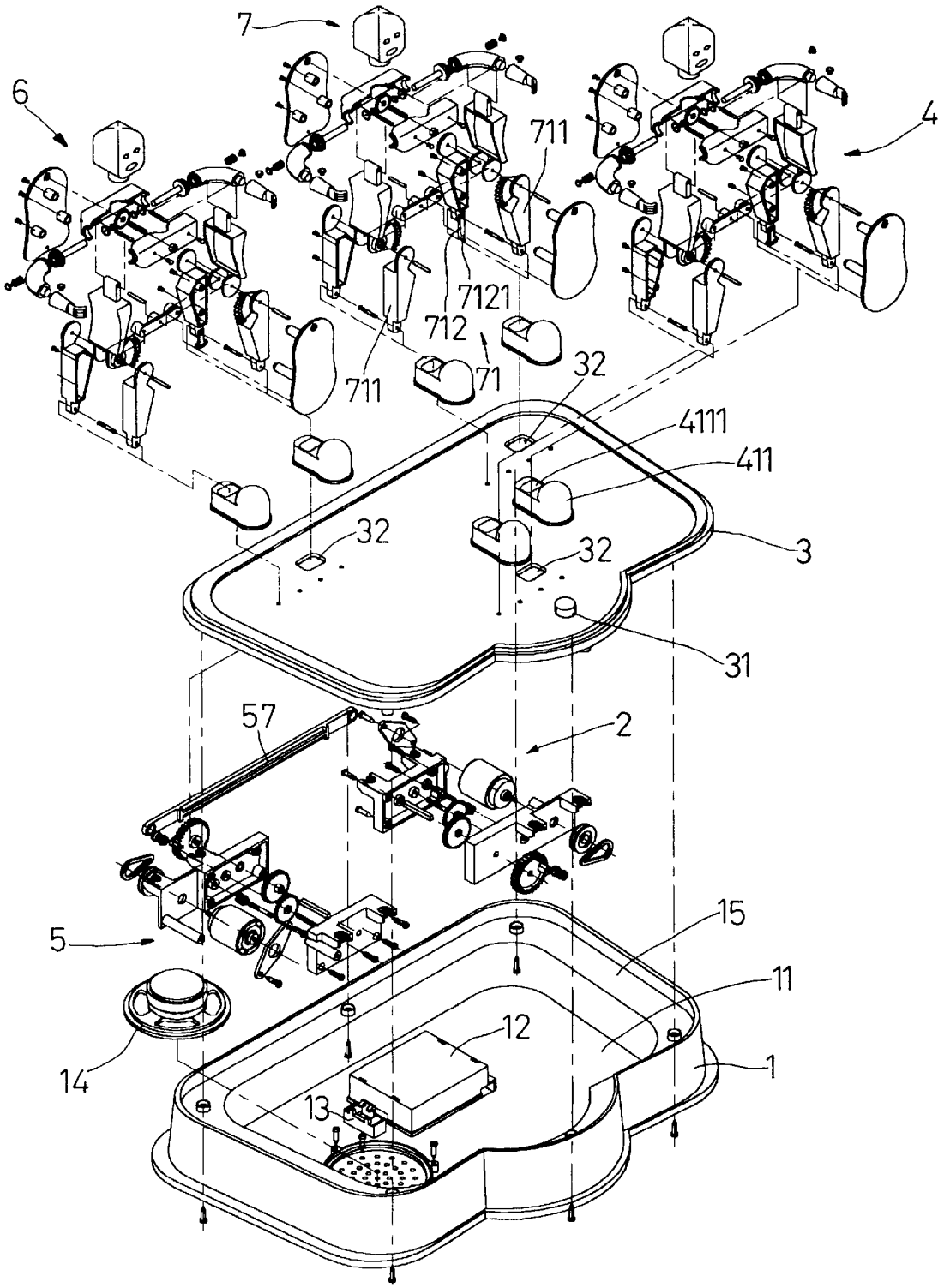
FIG. 9 is a perspective exploded view of a toy device of a second preferred embodiment in accordance with the present invention.
Figure 10:
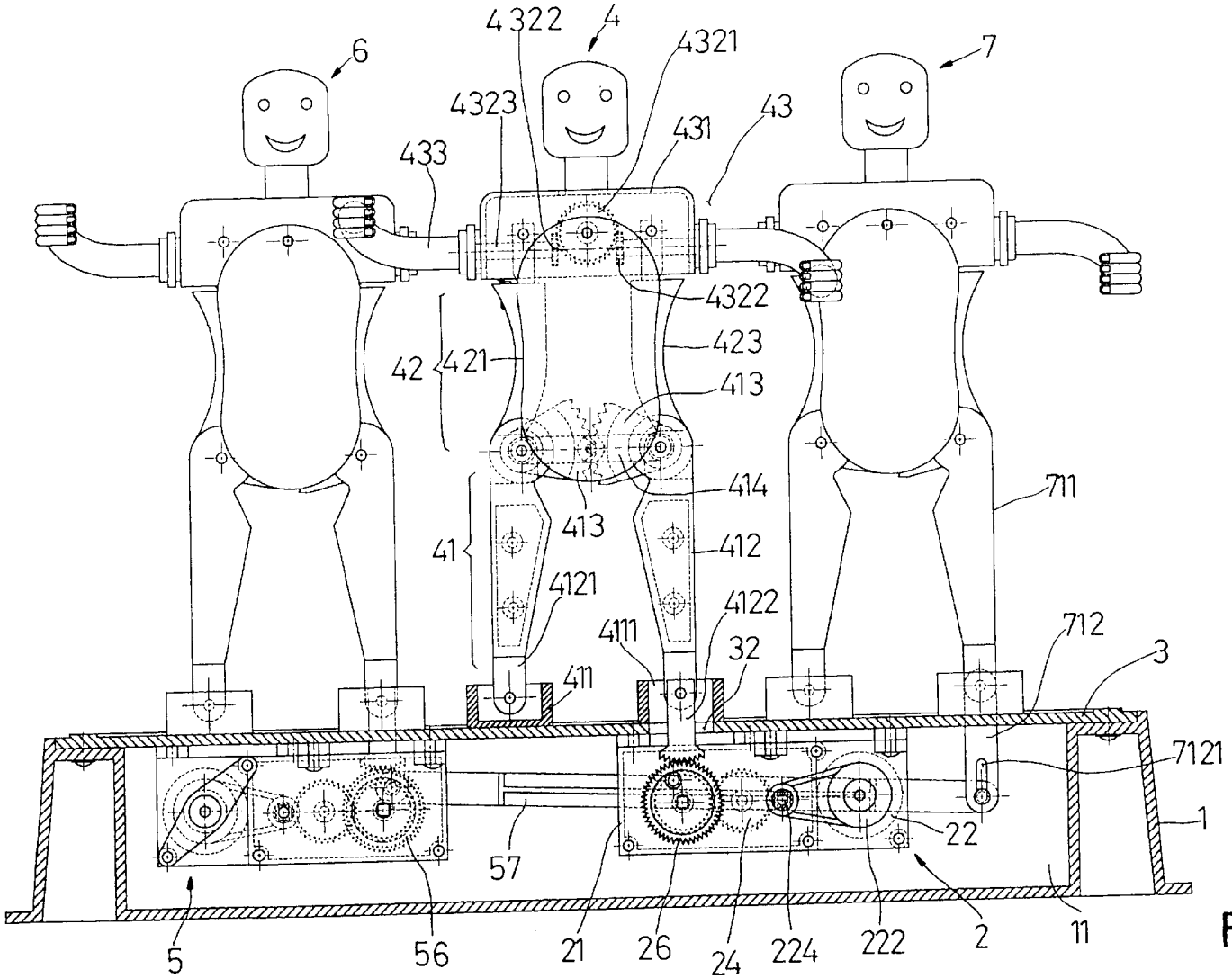
FIG. 10 is an assembly view of a toy device of a second preferred embodiment in accordance with the present invention.
Figure 11:
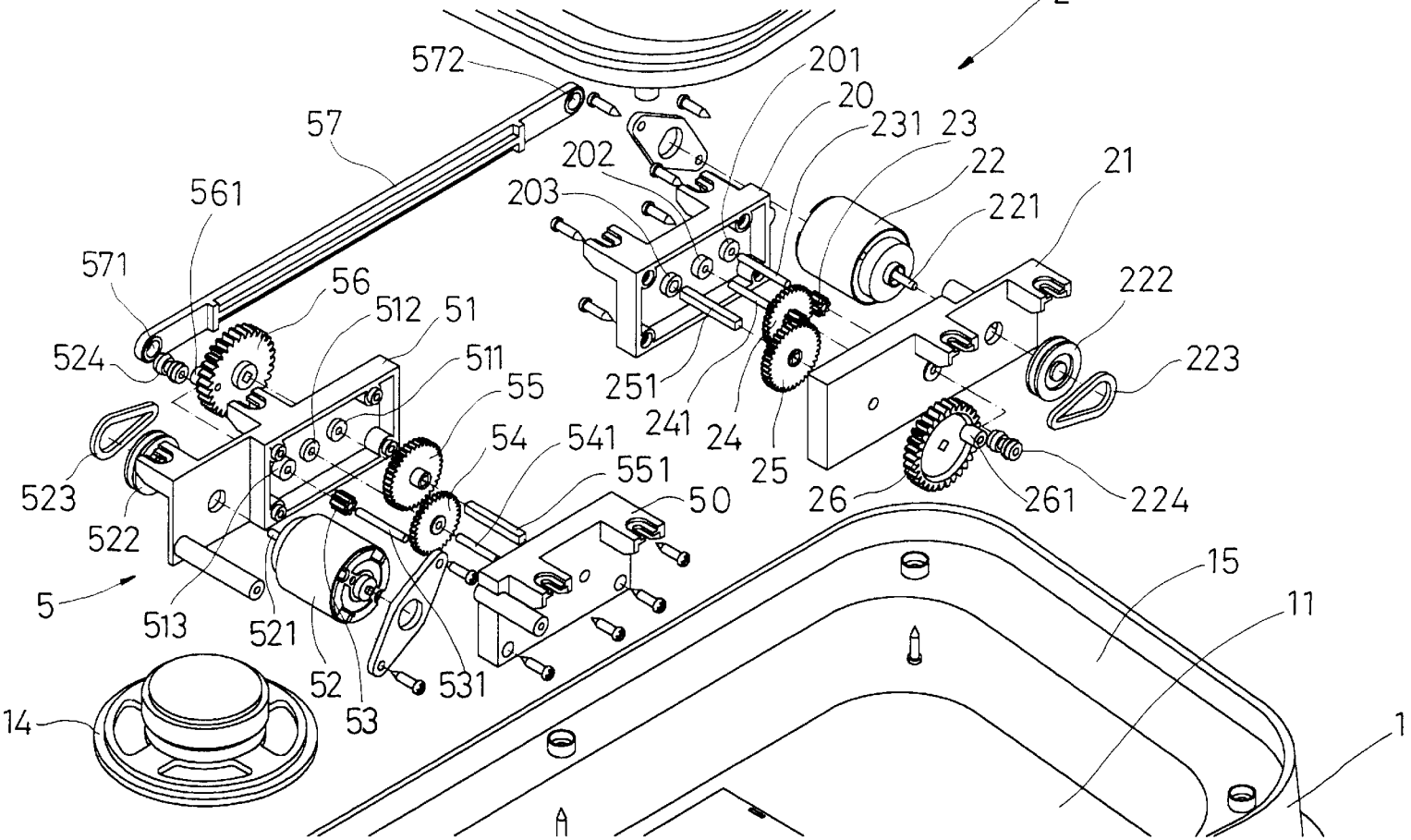
FIG. 11 is a perspective exploded view of a first drive mechanism and a second drive mechanism of a second preferred embodiment in accordance with the present invention.
Figure 12:
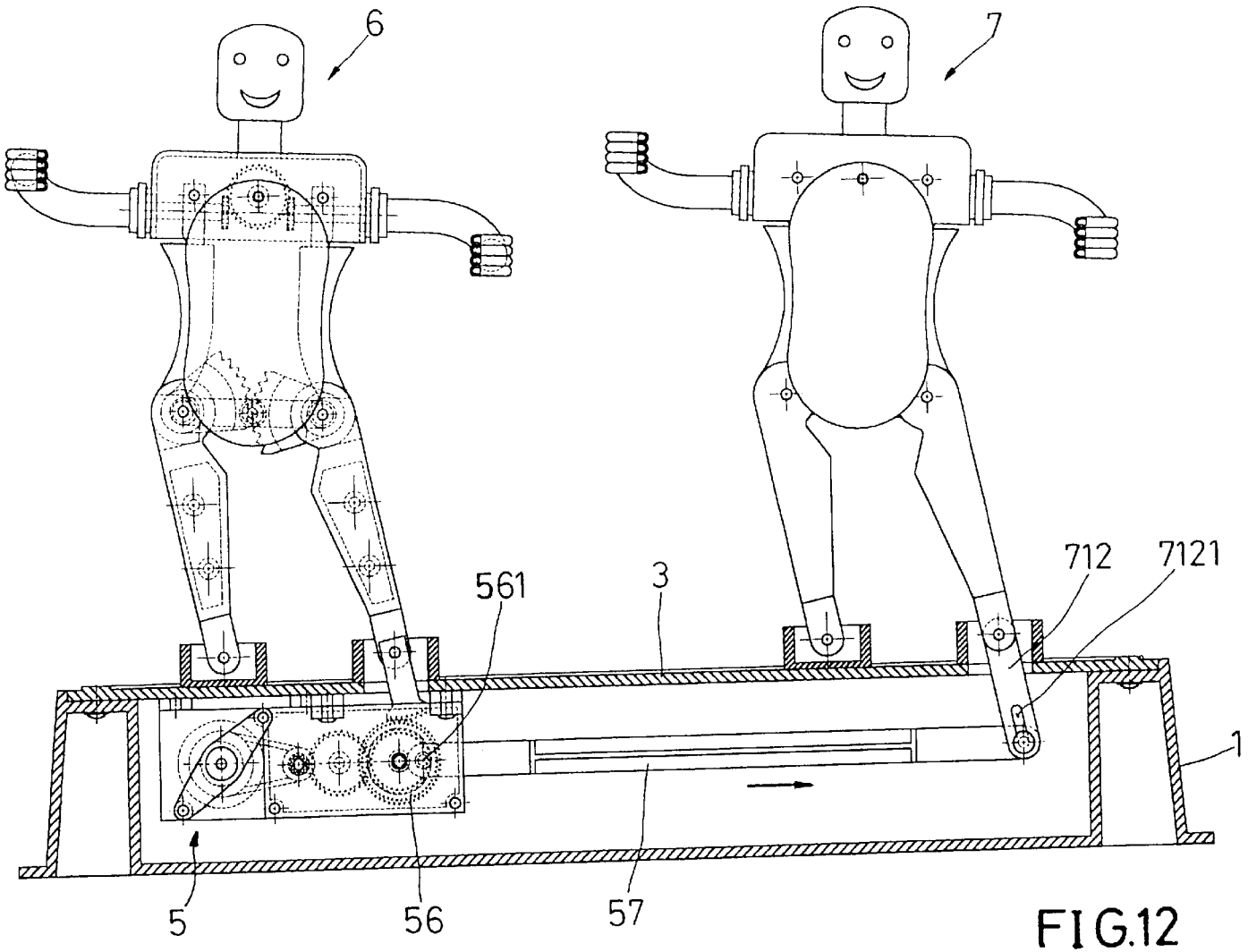
FIG. 12 is a schematic view illustrating an operation of a third toy figure of a second preferred embodiment in accordance with the present invention.
Figure 13:
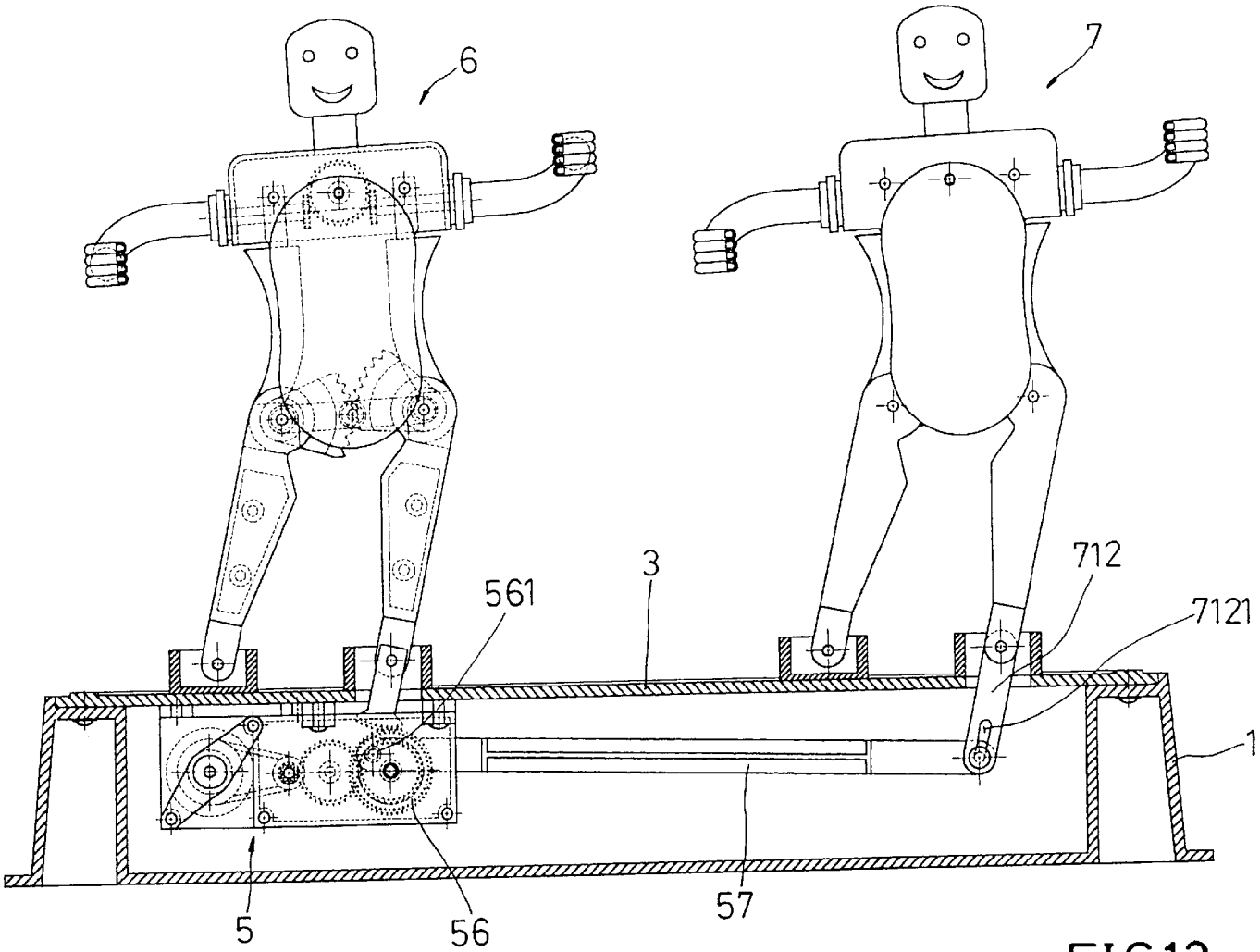
FIG. 13 is a schematic view illustrating another operation of a third toy figure of a second preferred embodiment in accordance with the present invention.

Referring to FIGS. 8 to 13, a second toy device comprises a base seat 1, a platform 3 disposed on the base seat 1, a first drive mechanism 2 disposed between the base seat 1 and the platform 3, a second drive mechanism 2 disposed between the base seat 1 and the platform 3, a first toy FIG. 4 disposed on the platform 3, a second toy FIG. 7 disposed on the platform 3, and a third toy FIG. 6 disposed on the platform 3.

The base seat 1 has a hollow interior 11, an inner periphery recess 15, a cell box 12 disposed in the base seat 1, a switch 13 disposed on the cell box 12, and a horn 14 disposed in the base seat 1.

The platform 3 is inserted in the inner periphery recess 15 of the base seat 1. The platform 3 has a pressing button 31 and an oblong aperture 32.

The first drive mechanism 2 has a first male mount 20, a first female mount 21 engaging with the first male mount 20, a first motor 22 disposed between the first male mount 20 and the first female mount 21, a first shaft 231 disposed between the first male mount 20 and the first female mount 21, a second shaft 241 disposed between the first male mount 20 and the first female mount 21, and a third shaft 251 disposed between the first male mount 20 and the first female mount 21.

A first gear 23, a second gear 24, and a third gear 25 are disposed between the first male mount 20 and the first female mount 21.

A first belt pulley 222, a first belt roller 224, and a fourth gear 26 are disposed on the first female mount 21. An eccentric hollow pillar 261 is disposed on the fourth gear 26.

The first motor 22 has a first motor shaft 221 passing through the first female mount 21 and the first belt pulley 222.

The first male mount 20 has a first hollow post 201 receiving the first shaft 231, a second hollow post 202 receiving the second shaft 241, and a third hollow post 203 receiving the third shaft 251.

The first shaft 231 passes through the first gear 23, the first female mount 21, and the first belt roller 224.

The second shaft 241 passes through the second gear 24.

The third shaft 251 passes through the third gear 25, the first female mount 21, and the fourth gear 26.

A first belt 223 surrounds the first belt pulley 222 and the first belt roller 224.

The first gear 23 engages with the second gear 24. The second gear 24 engages with the third gear 25.

The first motor 22 drives the first motor shaft 221 to rotate. The first motor shaft 221 drives the first belt pulley 222 to rotate. The first belt pulley 222 drives the first belt roller 224 to rotate. The first belt roller 224 drives the first shaft 231 to rotate. The first shaft 231 drives the first gear 23 to rotate. The first gear 23 drives the second gear 24 to rotate. The second gear 24 drives the third gear 25 to rotate. The third gear 25 drives the third shaft 251 to rotate. The third shaft 251 drives the fourth gear 26 to rotate.

The first toy FIG. 4 has a trunk 42, a pair of lower limbs 41 connected to the trunk 42, a pair of upper limbs 43 connected to the trunk 42, and a head 434 disposed on the trunk 42.

A blocking plate 414 is disposed between the two lower limbs 41. The blocking plate 414 has a plurality of through apertures 4141.

Each of the lower limbs 41 has a foot 411 and a leg 412. The foot 411 has an oblong hole 4111. The leg 412 has a lower lobe 4121, an upper lobe 4123, and a toothed block 413 connected to the upper lobe 4123. The toothed block 413 has a plurality of teeth 4131. The lower lobe 4121 of the leg 412 is inserted in the oblong hole 4111 of the foot 411.

A toothed connection plate 4122 couples with the leg 412. A lower portion of the toothed connection plate 4122 and the lower lobe 4121 of the leg 412 are fastened together. A lower portion of the toothed connection plate 4122 is inserted in the oblong hole 4111 of the foot 411 and the oblong aperture 32 of the platform 3 to engage with the fourth gear 26.

The trunk 42 has a front plate 421, a rear plate 422, a pair of lateral casings 423 disposed between the front plate 421 and the rear plate 422, and an upper box 431 disposed on the front plate 421 and the rear plate 422. The front plate 421 has an upper circular hole 4211 and a plurality of solid rods 4212.

The rear plate 422 has an upper round hole 4221 and a plurality of hollow rods 4222 receiving the solid rods 4212.

Each of the lateral casings 423 has a pair of lower lug plates 4231 and an upper bar 4232.

Each end of the blocking plate 414 is inserted in a spacing formed between the respective pair of the lower lug plates 4231.

The upper lobe 4123 and the respective lower lug plate 4231 are fastened pivotally.

The upper box 431 has two openings 4312 and a hollow column 4311.

A vibrating mechanism 432 is disposed in the upper box 431. The vibrating mechanism 432 has a toothed wheel 4321, a pair of pinions 4322, and a pair of transmission rods 4323 inserted through the openings 4312 of the upper box 431.

Each of the upper limbs 43 has an arm 433 connected to the respective transmission rod 4323, and a hand 4331 connected to the arm 433.

The structure of the second toy FIG. 7 is the same as the first toy FIG. 4. The structure of the third toy FIG. 6 is the same as the first toy FIG. 4.

The second drive mechanism 5 has a second male mount 51, a second female mount 50 engaging with the second male mount 51, a second motor 52 disposed between the second male mount 51 and the second female mount 50, a fourth shaft 531 disposed between the second male mount 51 and the second female mount 50, a fifth shaft 541 disposed between the second male mount 51 and the second female mount 50, and a sixth shaft 551 disposed between the second male mount 51 and the second female mount 50.

A fifth gear 53, a sixth gear 54, and a seventh gear 55 are disposed between the second male mount 51 and the second female mount 50.

A second belt pulley 522, a second belt roller 524, and an eighth gear 56 are disposed on the second male mount 51. A second eccentric hollow pillar 561 is disposed on the eighth gear 56.

The second motor 52 has a second motor shaft 521 passing through the second male mount 51 and the second belt pulley 522.

The second male mount 51 has a fourth hollow post 513 receiving the fourth shaft 531, a fifth hollow post 512 receiving the fifth shaft 541, and a sixth hollow post 511 receiving the sixth shaft 551.

The fourth shaft 531 passes through the fifth gear 53, the second male mount 51, and the second belt roller 524.

The fifth shaft 541 passes through the sixth gear 54.

The sixth shaft 551 passes through the seventh gear 55, the second male mount 51, and the eighth gear 56.

A second belt 523 surrounds the second belt pulley 522 and the second belt roller 524.

The fifth gear 53 engages with the sixth gear 54. The sixth gear 54 engages with the seventh gear 55.

The second motor 52 drives the second motor shaft 521 to rotate. The second motor shaft 521 drives the second belt pulley 522 to rotate. The second belt pulley 522 drives the second belt roller 524 to rotate. The second belt roller 524 drives the fourth shaft 531 to rotate. The fourth shaft 531 drives the fifth gear 53 to rotate. The fifth gear 53 drives the sixth gear 54 to rotate. The sixth gear 54 drives the seventh gear 55 to rotate. The seventh gear 55 drives the sixth shaft 551 to rotate. The sixth shaft 551 drives the eighth gear 56 to rotate.

A link rod 57 has a first through hole 571 receiving the second belt roller 524 and a second through hole 572.

A first doll A encloses the first toy FIG. 4. A second doll B encloses the second toy FIG. 7. A third doll C encloses the third toy FIG. 6.

The second toy FIG. 7 comprises a lower limb 71 connected to a connection panel 712. The connection panel 712 has a slot 7121. The link rod 57 and the connection panel 712 are fastened together via the slot 7121 and the second through hole 572.

The present invention is not limited to the above embodiments but various modification thereof may be made. Furthermore, various changes in form and detail may be made without departing from the scope of the present invention.

I claim:

1. A toy device comprising:

a base seat, a platform disposed on the base seat, a first drive mechanism disposed between the base seat and the platform, and a first toy figure disposed on the platform, the base seat having a hollow interior, an inner periphery recess, a cell box disposed in the base seat, a switch disposed on the cell box, and a horn disposed in the base seat, the platform inserted in the inner periphery recess of the base seat, the platform having a pressing button and an oblong aperture, the first drive mechanism having a first male mount, a first female mount engaging with the first male mount, a first motor disposed between the first male mount and the first female mount, a first shaft disposed between the first male mount and the first female mount, a second shaft disposed between the first male mount and the first female mount, and a third shaft disposed between the first male mount and the first female mount, a first gear, a second gear, and a third gear disposed between the first male mount and the first female mount, a first belt pulley, a first belt roller, and a fourth gear disposed on the first female mount, an eccentric hollow pillar disposed on the fourth gear, the first motor having a first motor shaft passing through the first female mount and the first belt pulley, the first male mount having a first hollow post receiving the first shaft, a second hollow post receiving the second shaft, and a third hollow post receiving the third shaft, the first shaft passing through the first gear, the first female mount, and the first belt roller, the second shaft passing through the second gear, the third shaft passing through the third gear, the first female mount, and the fourth gear, a first belt surrounding the first belt pulley and the first belt roller, the first gear engaging with the second gear, the second gear engaging with the third gear, the first motor driving the first motor shaft to rotate, the first motor shaft driving the first belt pulley to rotate, the first belt pulley driving the first belt roller to rotate, the first belt roller driving the first shaft to rotate, the first shaft driving the first gear to rotate, the first gear driving the second gear to rotate, the second gear driving the third gear to rotate, the third gear driving the third shaft to rotate, the third shaft driving the fourth gear to rotate, the first toy figure having a trunk, a pair of lower limbs connected to the trunk, a pair of upper limbs connected to the trunk, and a head disposed on the trunk, a blocking plate disposed between the two lower limbs, the blocking plate having a plurality of through apertures, each of the lower limbs having a foot and a leg, each foot having an oblong hole, each leg having a lower lobe, an upper lobe, and a toothed block connected to the upper lobe, the toothed block having a plurality of teeth, the lower lobe of each leg inserted in the oblong hole of a respective foot, a toothed connection plate coupling with one of the legs, a lower portion of the toothed connection plate and the lower lobe of the leg being fastened together, a lower portion of the toothed connection plate inserted in the oblong hole of the foot and the oblong aperture of the platform to engage with the fourth gear, the trunk having a front plate, a rear plate, a pair of lateral casings disposed between the front plate and the rear plate, and an upper box disposed on the front plate and the rear plate, the front plate having an upper circular hole and a plurality of solid rods, the rear plate having an upper round hole and a plurality of hollow rods receiving the solid rods, each of the lateral casings having a pair of lower lug plates and an upper bar, each end of the blocking plate inserted in a spacing formed between the respective pair of the lower lug plates, each upper lobe and a respective lower lug plate being fastened pivotally, the upper box having two openings and a hollow column, a vibrating mechanism disposed in the upper box, the vibrating mechanism having a toothed wheel, a pair of pinions, and a pair of transmission rods inserted through the openings of the upper box, and each of the upper limbs having an arm connected to the respective transmission rod, and a hand connected to the arm.

2. The toy device as claimed in claim 1, wherein a second toy figure is disposed on the platform.

3. The toy device as claimed in claim 2, wherein a third toy figure is disposed on the platform.

* * * * *